United States Patent [19]

Jindra

[11] Patent Number: 4,574,497

[45] Date of Patent: Mar. 11, 1986

[54] SAFETY SHOE HAVING IMPROVED SOLE CONSTRUCTION

[75] Inventor: Frank J. Jindra, Endicott, N.Y.

[73] Assignee: Endicott Johnson Corporation, Endicott, N.Y.

[21] Appl. No.: 693,290

[22] Filed: Jan. 23, 1985

[51] Int. Cl.[4] ..... A43C 13/14

[52] U.S. Cl. ..... 36/77 R; 36/72 R; 36/107

[58] Field of Search ..... 36/77 R, 77 M, 72 R, 36/72 A, 107, 108, 75

[56] References Cited

U.S. PATENT DOCUMENTS

| | | | |
|---|---|---|---|
| 3,034,235 | 5/1962 | Hunting et al. | 36/77 R |
| 3,444,572 | 5/1969 | Broughton | 36/77 R |
| 3,798,804 | 3/1974 | Funck | 36/72 R |
| 4,011,667 | 3/1977 | Greenan | 36/77 R |

FOREIGN PATENT DOCUMENTS

| | | | |
|---|---|---|---|
| 1280701 | 11/1961 | France | 36/77 R |
| 1436501 | 5/1976 | United Kingdom | 36/77 R |

OTHER PUBLICATIONS

*Plastics,* Polyethylene, a High-Dielectric Thermoplastic with Extensive Market Potentials, by C. S. Meyers, Sep. 1944, pp. 39–43 & 100.

*Primary Examiner*—James Kee Chi

*Attorney, Agent, or Firm*—Kane, Dalsimer, Kane, Sullivan & Kurucz

[57] ABSTRACT

This invention relates to a safety shoe of the type having an upper with a box toe cap in the toe portion thereof and an outer sole of relatively yielding, resilient and flexible material secured to the upper and having a supporting plate of relatively rigid material embedded in and surrounded by the material of the outer sole and having a configuration similar to the generally U-shaped configuration of the lower edge of the safety box toe and being disposed beneath said lower edge in registry therewith so as to impart additional support thereto when a blow or force is applied to the toe cap.

In a preferred embodiment of the invention the supporting plate is formed of a relatively rigid, hard, polymeric material and has a plurality of apertures formed therein into which the material of the outer sole extends to help anchor the supporting plate in position.

5 Claims, 6 Drawing Figures

SAFETY SHOE HAVING IMPROVED SOLE CONSTRUCTION

BACKGROUND OF THE INVENTION

Safety shoes have conventionally been made with safety box toe caps made of relatively hard, rigid material such as steel and with outer soles made of relatively hard, non-yielding material on which the lower edge of the toe caps receive support when a force or blow is applied to or through the toe cap, thus protecting the toes of the wearer from injury. Shoes of this type have provided adequate protection to the wearer. However, due to the weight and relative rigidity of the sole of the shoe, safety shoes of this type are somewhat less comfortable than conventional shoes. Relatively light, soft, yielding, resilient and flexible soles would impart more comfort to such shoes. However, soles of this type do not provide adequate support to the safety toe cap when a force or blow is imparted thereto.

BRIEF DESCRIPTION OF THE PRIOR ART

Attempts have been made to overcome this problem by providing a supporting plate on top of the outer sole as suggested in U.S. Pat. No. 4,011,667 for Safety Shoes, granted on Mar. 15, 1977 to Wirt G. Greenan. However, arrangements of this type have disadvantages and are not altogether satisfactory. Thus, where a flat plate coextensive with the entire area of the toe cap is employed, the plate imparts rigidity to that entire area of the flexible sole and defeats the advantage of using a flexible sole. Where a U-shaped plate is employed, there is difficulty in obtaining registry with the lower edge of the toe cap complicating the production of the safety shoe and use of this safety shoe under strenuous, rugged conditions may cause displacement of the supporting plate. Furthermore, assembly of the supporting plate on top of the sole complicates the production of the shoe and distracts from both the comfort and appearance of the shoe sole.

SUMMARY OF THE INVENTION

It is a primary object of the present invention to overcome the aforesaid disadvantages of the prior art and to provide an improved safety shoe having a relatively lightweight, soft, yielding, resilient and flexible sole which is simple to manufacture, which facilitates construction and assembly of the shoe but which provides adequate support for the safety box toe cap when a force or blow is applied thereto and which will remain in properly assembled relationship and provide such support throughout the life of the shoe.

I accomplish these improved results by providing the safety shoe with a relatively lightweight, soft, yielding, resilient and flexible outer sole having molded therein a supporting plate of a relatively rigid and hard material and of generally U-shaped configuration in registry with the lower edge of the safety box toe cap. The material of the sole surrounds and encases the plate and preferably extends into apertures formed therein insuring accurate location of the plate and anchoring it against displacement. In a preferred embodiment of the invention the supporting plate is made of a hard, rigid, polymer material.

DETAILED DESCRIPTION

Figure 1:
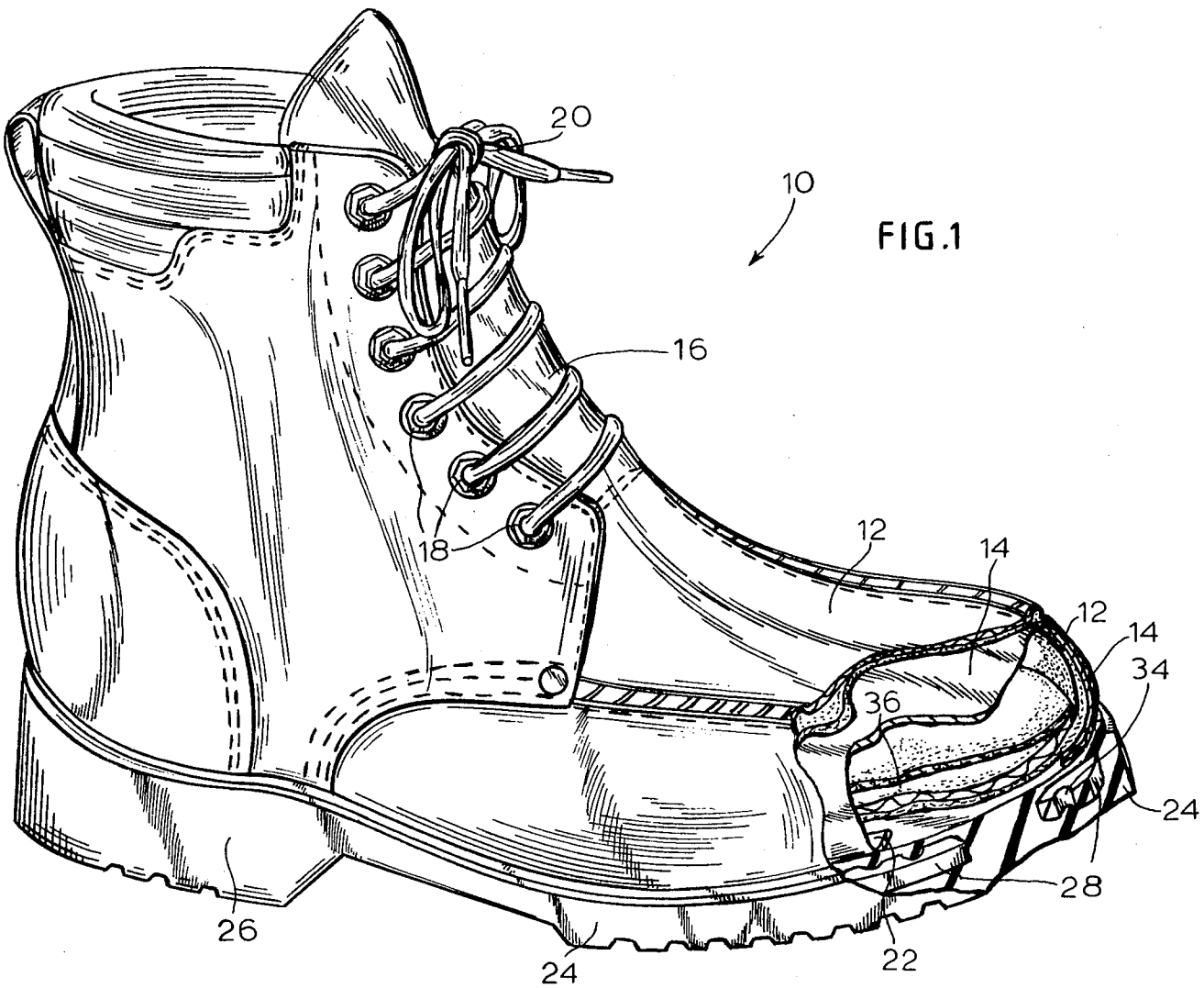
FIG. 1 is a perspective view of a safety shoe embodying my invention with the toe portion partially broken away so as to show the location of the safety toe cap and of the supporting plate embedded in the sole of the shoe.
Figure 3:
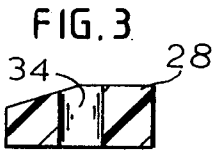
FIGS. 3 and 4 are cross-sectional views taken in the direction of the arrows and on the lines 3—3 and 4—4 of FIG. 2.
Figure 4:
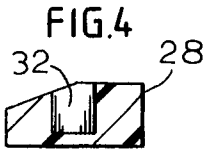
Figure 5:
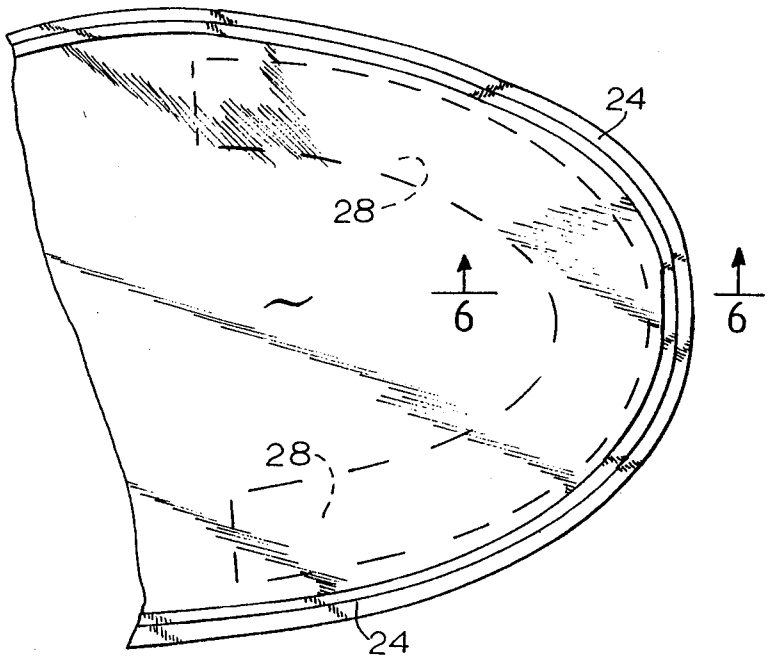
FIG. 5 is a top plan view of the toe portion of the sole showing the location of the toe plate in dotted lines.
Figure 2:
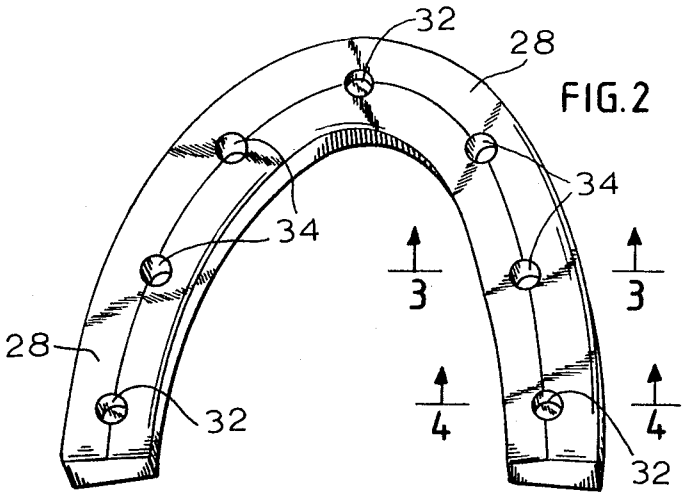
FIG. 2 is a top plan view of a supporting plate in accordance with my invention.

A safety shoe embodying my invention is shown at 10 in FIG. 1 and may consist of a conventional upper 12 made of leather or other suitable material and can conveniently be formed with a tongue 16 and can be secured in closed position by conventional shoe laces 20 extending through the usual grommeted apertures 18.

The upper is formed with a toe portion in which a conventional toe cap 14, made of a hard, rigid material such as steel, is disposed. A suitable cloth lining may be provided inside the metal toe cap and padding may be provided between the toe cap and the leather of the shoe upper.

The toe cap is of conventional design and has an edge portion 22 extending around the lower edge thereof in a generally U-shaped configuration. The outer sole 24 made of a relatively soft, yielding, resilient and flexible material is suitably secured adjacent its peripheral edge to the shoe upper.

The illustrated shoe is of cemented construction and the sole is cemented to the lower edge portion of the upper, but it should be understood that it may also be of welt construction. The illustrated sole has an integral heel portion 26 and may be molded as a unit from a suitable material which is relatively lightweight, soft, yielding, resilient and flexible.

Examples of material that may be employed are thermoplastic rubber or polyurethane and in a preferred embodiment I employ polyurethane in which the center area of the sole from the toe to the arch preferably had durometer readings on the Shore A scale of 30 to 40 with the outer surface edge showing readings of from 55–65.

Embedded in the toe portion of the outer sole beneath the lower edge 22 of the safety box toe and in registry therewith is my improved supporting plate 28 of generally U-shaped configuration similar to that of the lower edge of the toe cap. The supporting plate is preferably made of a suitable relatively hard, rigid, polymer material such as a polyalkene or polyvinylchloride; although under certain circumstances it may be made of metal, provided there are no sharp edges in the plate.

The supporting plate is preferably molded from polyethylene with a durometer reading on the Shore A scale of 85 or above, preferably above 90. Very satisfactory results have been obtained using polyethylene having a durometer reading in the neighborhood of 94 and 95.

Apertures 32 and 34 may be molded directly into the supporting plate, the apertures 34 extending completely through the plate, and the apertures 32 extending only partially therethrough so as to facilitate supporting or locating the plate upon pins in the mold. The supporting plate 28 is preferably molded directly into the toe portion of the outer sole in a position in registry with the lower edge of the toe cap by well known molding procedures and the material of the outer sole preferably completely surrounds the supporting plate and extends into the aperture 34 so as to help secure the supporting plate firmly in position and anchor it against displacement.

When the supporting plate is thus molded directly into the toe portion of the outer sole and the shoe assembled in the fashion indicated with the supporting plate disposed beneath and in registry with the lower edge of the toe cap, then the supporting plate lends additional support to the toe cap when a blow or force is applied thereto, thus protecting the foot of the wearer against injury. The area of the supporting plate should be sufficient to provide support for the toe cap on the flexible sole material employed in the sole so as to provide protection to the wearer against a 100 pound compression or impact force applied to the toe cap. I have found that in materials of the type indicated above a supporting plate of approximately the same length as the lower edge of the toe cap and of a width of approximately ½ inch and a thickness of approximately ¼ inch serves very satisfactorily.

Figure 6:
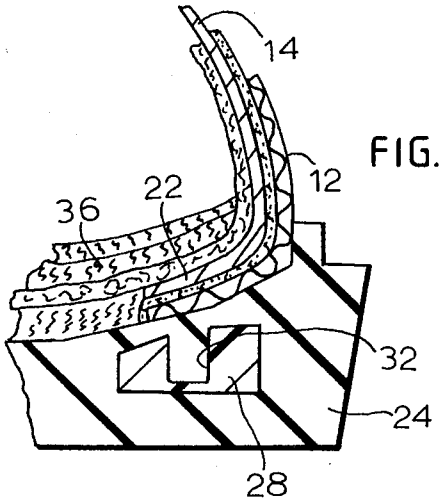
FIG. 6 is a sectional view on the line 6—6 of FIG. 5 showing the forward portion of the toe of the shoe and the relative positions of the safety box toe cap and supporting plate.

Referring to FIGS. 1 and 6 of the drawings, it will be seen that the flanged lower edge of the toe cap is disposed at a slight angle. I have found that improved results are obtained when the upper surface of the supporting plate adjacent the inner edge thereof is also bevelled at an angle somewhat similar to that of the lower edge of the toe cap.

It should be understood that an insole and padding material may be provided inside the shoe over the upper surface of the outer sole as shown at 36.

From the foregoing, it will be seen that I have provided a safety shoe having an improved sole construction utilizing a relatively soft, flexible, yielding and resilient material. Molded directly into the toe portion of the outer sole is a supporting plate of generally U-shaped configuration conforming to and in registry with the lower edge of the toe cap whereby additional support is provided for the toe cap when a force or impact is applied thereto.

I claim:

1. In a safety shoe of the type having a shoe upper with a toe portion having a safety box toe cap of strong, rigid material disposed inside the toe portion and formed with a lower edge of generally U-shaped configuration, the improvement comprising:

an outer sole of a relatively soft, yielding, resilient and flexible material secured adjacent its peripheral edges to the shoe upper and formed with a toe portion adjacent its forward end above which the lower edge of the safety box toe cap is disposed and a supporting plate formed of a relatively rigid polymer material embedded in and surrounded by the material of the outer sole, said supporting plate being of generally U-shaped configuration similar to the lower edge of the cap and being in registry therewith so that when a force is applied to or through the said safety box toe cap additional support for the cap is provided by said supporting plate.

2. The improvement in a safety shoe as set forth in claim 1 in which the durometer of the polymer material on the Shore A scale is at least 85.

3. The improvement in a safety shoe as set forth in claim 2 in which the supporting plate is formed with apertures into which the material of the outer sole extends.

4. The improvement in a safety shoe as set forth in claim 1 in which the outer sole is made of polyurethane and the supporting plate is made of polyethylene.

5. The improvement in a safety shoe as set forth in claim 1 in which the upper surface of the supporting plate in a direction from its outer edge towards its inner edge is at a downwardly disposed angle to the horizontal and the lower edge of the toe cap is in the form of a flange disposed at an approximately similar angle.

* * * * *